US006311845B1

(12) United States Patent
Uren et al.

(10) Patent No.: US 6,311,845 B1
(45) Date of Patent: Nov. 6, 2001

(54) PRODUCT PACKAGING ARRANGEMENT HAVING RETAINER

(75) Inventors: Wayne E. Uren, Chesterfield, MO (US); Jeffrey P. Pirro, Marcellus, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/537,453

(22) Filed: Mar. 27, 2000

Related U.S. Application Data

(60) Provisional application No. 60/162,991, filed on Nov. 1, 1999.

(51) Int. Cl.[7] ..... B65D 5/54

(52) U.S. Cl. ..... 206/774; 206/705; 206/499

(58) Field of Search ..... 206/461, 471, 206/485, 499, 503, 509, 511, 526, 703–705, 736, 756, 774; 211/126.12

(56) References Cited

U.S. PATENT DOCUMENTS

| | | | | |
|---|---|---|---|---|
| 3,187,889 | * | 6/1965 | Sinclair | 206/499 |
| 3,872,966 | * | 3/1975 | Gordon et al. | 206/499 |
| 4,082,187 | * | 4/1978 | Carlson | 206/526 |
| 4,582,194 | | 4/1986 | Karpiloff et al. | 206/44 R |
| 4,779,734 | | 10/1988 | Kydonieus | 206/470 |
| 4,781,289 | | 11/1988 | Perkins | 206/45.24 |
| 4,784,268 | | 11/1988 | Perchak | 206/461 |
| 4,842,141 | | 6/1989 | Segal | 206/462 |
| 4,896,770 | * | 1/1990 | Calcerano et al. | 206/705 |
| 4,958,731 | * | 9/1990 | Calcerano | 206/705 |
| 5,012,928 | | 5/1991 | Proffitt et al. | 206/508 |
| 5,052,557 | | 10/1991 | Contino et al. | 206/427 |
| 5,259,505 | | 11/1993 | Sobel | 206/509 |
| 5,411,140 | | 5/1995 | Byer | 206/504 |
| 5,542,539 | * | 8/1996 | Early | 206/499 |
| 5,573,117 | | 11/1996 | Adams | 206/449 |
| 5,586,657 | * | 12/1996 | Ward et al. | 206/705 |
| 5,649,624 | | 7/1997 | Seaton | 206/461 |
| 5,819,939 | | 10/1998 | Boyer | 206/461 |
| 5,878,884 | * | 3/1999 | Mayled | 206/485 |
| 5,878,885 | | 3/1999 | Wangu et al. | 206/461 |
| 5,927,496 | | 7/1999 | Seaton et al. | 206/461 |

* cited by examiner

*Primary Examiner*—Jim Foster
(74) *Attorney, Agent, or Firm*—Stewart A. Fraser

(57) ABSTRACT

A shipping and display container having packaged product arranged for shipping and display to consumers that minimizes shipping space and manual handling of the individual packages contained therein. The container has side walls and top and bottom walls defining a compartment and a removable section that is affixed to the container during shipment of the packaged product and is removed to provide an opening for displaying product for sale to consumers. The container further includes a plurality of irregular shaped packaged articles each having a display card and a housing for housing one or more products, wherein the housing has a thickness substantially greater than the thickness of the display card. The arrangement includes an upper packaged article offset and supported on a lower packaged article to provide efficient use of container space. The packages may also include a retainer for retaining the upper packaged articles supported on the lower packaged article. According to one embodiment, the retainer includes a pair of raised dimples formed on an upper surface of the housing. According to another embodiment, the housing has a depression formed in a lower surface for engaging the raised dimples. According to a further embodiment, a channel is provided on an upper surface of the housing for engaging a lower end of the upper package.

18 Claims, 6 Drawing Sheets

PRODUCT PACKAGING ARRANGEMENT HAVING RETAINER

CROSS-REFERENCE TO RELATED APPLICATIONS

This application claims the benefit of U.S. Provisional Application No. 60/162,991, filed on Nov. 1, 1999.

BACKGROUND OF THE INVENTION

The present invention generally relates to bulk packaging and display of articles for sale and, more particularly, to a container and packaging arrangement for shipping and displaying irregularly shaped articles, such as packaged batteries, for sale to consumers.

The common practice for displaying small and lightweight retail items, such as alkaline batteries, is to package the items in thermoformed blister card packages and place the blister card packages on shelves or hang the packages on hooks on various display racks. The conventional blister card battery package is composed of a display card which provides a generally stiff supportive backing, usually composed of cardboard, and a thermoformed polymeric blister that is typically heat sealed or otherwise connected to the display card. The display card provides support for displaying the merchandise for sale and contains print and graphics with suitable indicia such as trademarks, advertising, and instructions. The thermoformed blister generally comprises one or more pieces of clear polymeric material, e.g., plastic, that defines a compartment, generally having a shape to fit over and cover the product(s) contained within the package. The blister package isolates the product(s) from the purchaser and prevents inadvertent damage that can result from repeated handling prior to sale, while further allowing for the orderly display of product(s) for sale to consumers.

Blister card packages for containing batteries, as well as other types of products, typically form irregularly shaped articles, since the polymeric blister, which is generally located at one end, is much greater in front-to-rear depth than the display card that extends throughout the remainder of the package. As a result, the blister card package has a lop-sided configuration which makes it difficult to efficiently package bulk articles for shipment from the article manufacturing facility to a promotional display location, such as a retail store, where the packaged articles are placed on display trays or racks for display and sale to consumers.

It has been common practice for irregularly shaped blister card packages to be shipped in bulk in rectangular cardboard shipping containers with the blister card packages arranged in a staggered reverse orientation in which the narrow part of one package is juxtaposed with the wide part of an adjacent package to minimize volume consumption. However, when the shipping container is opened at the retail store to display the packages, the blister packages must be individually handled by store personnel to place the individual packages on the display trays or display racks. The manual handling includes arranging the individual packages so that the packages are oriented in the same direction and the graphics on each display card are displayed to face the consumers. The conventional approach for displaying irregularly shaped packaged products therefore involves manual handling which is generally time consuming and costly. Additionally, the shipping container is generally discarded once the blister card packages are manually relocated for display on the display trays or racks.

Accordingly, there is a need, heretofore unfulfilled, for a relatively inexpensive and easy to use container for shipping and displaying packaged products for sale and display to consumers in a manner that minimizes or eliminates the manual handling of individual articles, and offers efficient use of space. There is a further need to provide for such a container for shipping and displaying blister card packages, such as those containing batteries, which have an irregularly shaped package configuration.

SUMMARY OF THE INVENTION

The present invention provides for a product shipping and display container that houses packaged products arranged for shipping and display to consumers which offers efficient shipping space consumption and minimizes manual handling of the individual packages. To achieve this and other advantages, and in accordance with the purpose of the present invention as embodied and described herein, one aspect of the present invention provides for a combination container and arrangement of packaged articles for sale to consumers. The container has side walls and top and bottom walls defining a compartment, and removable material engaging the container to retain packaged articles during shipment of the packaged articles and removable to provide a dispensing opening for displaying the packaged articles for sale to consumers. The container contains a plurality of packaged articles each having a display card and a housing for housing one or more products, wherein the housing has a thickness substantially greater than the thickness of the display card. The packaged articles are arranged in the container with upper and lower packaged articles, wherein an upper packaged article is offset and supported on a lower packaged article to provide efficient use of space in the container. A retainer is formed on the lower packaged article for retaining the upper packaged article supported on the lower packaged article. Articles may be individually removed from the container through the dispensing opening.

According to another aspect of the present invention, an arrangement of packaged articles are provided which includes a lower packaged article and an upper packaged article. The lower and upper packaged articles each include a display card and a housing for housing one or more products, wherein the housing has a thickness substantially greater than the thickness of the display card. The lower packaged article has a retainer, preferably formed in an upper surface of the housing, for receiving the upper packaged article. Accordingly, the upper packaged article is supported on top of the lower packaged article and the upper and lower packaged articles are retained in a fixed relative position by the retainer.

According to a further aspect of the present invention, a packaged article for display in a stacked arrangement is provided having a display card and a housing for housing one or more products. The housing has a thickness substantially greater than the thickness of the display card. The packaged article has a retainer, preferably formed on an upper surface of the housing, for retaining another packaged article on top of the housing such that an upper article may be stacked on top of a lower article.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
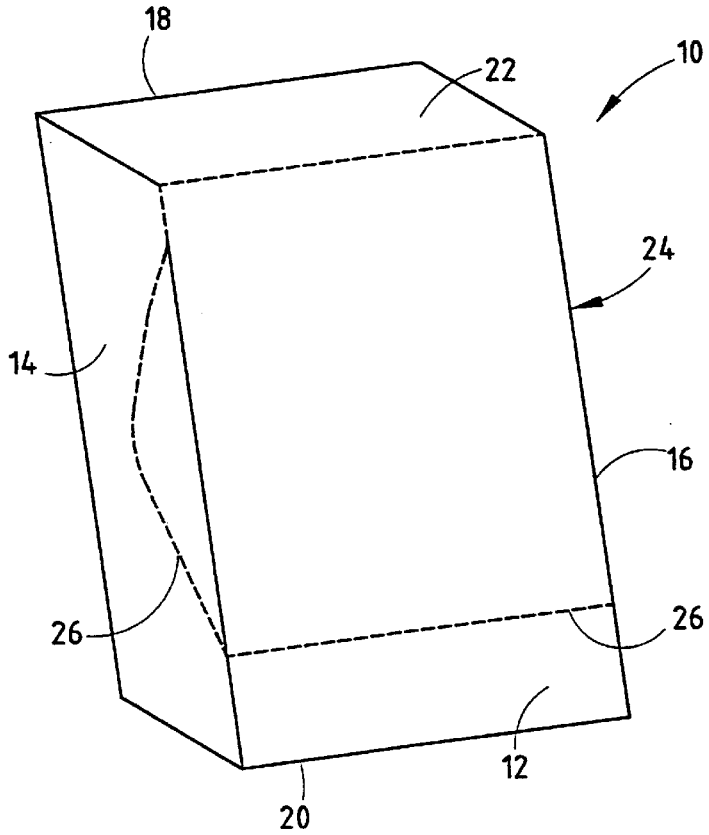
FIG. 1 is front perspective view of a container for shipping and displaying packaged products for sale according to the present invention.

For purposes of description herein, the terms "upper," "lower," "right," "left," "rear," "front," "vertical," "horizontal" and derivatives thereof shall relate to the invention as oriented in FIG. 1. However, it is to be understood that the invention may assume various alternative orientations and step sequences except where expressly specified to the contrary. It is also to be understood that the specific devices illustrated in the attached drawings, and described in the following specification are simply exemplary embodiments of the inventive concept defined in the appended claims. Hence, specific dimensions and physical characteristics relating to the embodiments disclosed herein are not to be considered as limiting, unless the claims expressly state otherwise.

Referring to FIG. 1, a product shipping and display container 10 is shown for containing a plurality of irregularly shaped packages, such as AA-size battery packages, for both shipping to retail stores and for promotional display to consumers in the retail stores. According to the specific example shown, the shipping and display container 10 is designed to house twelve battery packages, each package containing four AA-size batteries. The battery packages are efficiently arranged in container 10 to minimize volume consumption and are ready for display without requiring rehandling of individual packages. While the container 10 is shown and described in connection with a battery shipping and display container for housing AA-size batteries, it should be appreciated that the container 10 may be employed to ship and display various types, sizes and numbers of irregularly shaped articles in accordance with the teachings of the present invention.

The shipping and display container 10 is generally rectangular in shape, having six walls defining a compartment for containing the packaged articles. The walls include upstanding front wall 12, upstanding left side wall 14, upstanding right side wall 16, upstanding rear wall 18, lower wall 20 at the bottom, and upper wall 22 at the top. Container 10 is shown standing upright supported on the horizontally oriented bottom lower wall 20; however, container 10 is preferably tilted towards the rear wall 18 during display of the packaged products for sale to consumers. It should be appreciated that the container 10 may be moved into various positions during shipping and prior to display.

Figure 2:
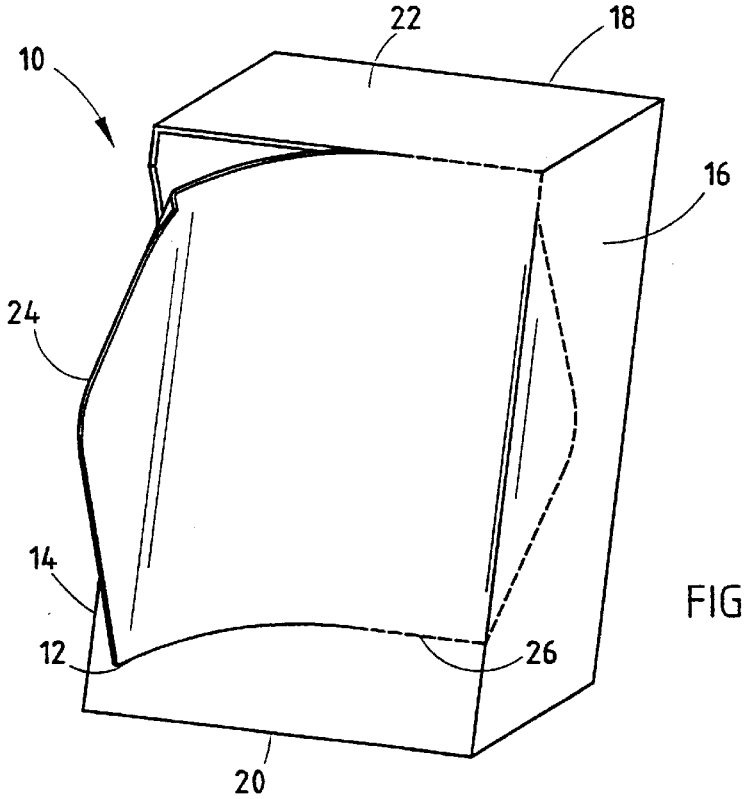
FIG. 2 is a front perspective view of the container shown partially opened.

Formed in the side walls 14 and 16 and front wall 12 are perforations 26 which define a removable tear section 24. Removable tear section 24 may be torn open at perforations 26 and removed from container 10 to provide a dispensing opening that allows for display of the packaged articles and removal of the packaged articles by consumers. The tear section 24 includes a substantial area of front wall 12, with the exception of the lower region which remains on the container 10 and is well suited to contain graphics or print such as battery size, trademark, and other indicia. The tear section 24 also includes a section, preferably towards the front side, of each of side walls 14 and 16 to allow easy rearward access at either side of the packages by a consumer. It should be appreciated that personnel in retail stores may easily remove the tear section 24 as shown in FIG. 2 by tearing along the perforations 26 in order to ready the container 10 and its packaged articles for display.

The removable tear section 24 serves as a removable material that engages the container during shipment of the packages and is removable to provide a dispensing opening for displaying the packages for sale to consumers. While a removable tear section 24 is shown and described herein, it should be appreciated that other removable materials may be employed to retain the packages in the container 10 during shipment. According to another embodiment, the removable material may include an outer wrapping, such as a sheet of clear polymeric material, enclosing the container 10 and blocking the dispensing opening to retain the packages therein, with the wrapping being removable to expose the dispensing opening during display. According to a further embodiment, the removable material may include a band, made up of polymeric material, cardboard, or other material extending around the front and rear walls 12 and 18 and left and right side walls 14 and 16 and at least partially cover the dispensing opening to thereby retain product in the container 10 during shipment, and being tearable to remove the band from the dispensing opening and expose the packages for displaying and dispensing. According to yet a further embodiment, the container 10 may be configured as a two-piece box generally having a box for providing left and right upstanding walls 14 and 16, rear upstanding wall 18, and lower and upper walls 20 and 22, and a removable cover providing the front upstanding wall 12, with the cover being removable to provide the dispensing opening.

Figure 3:
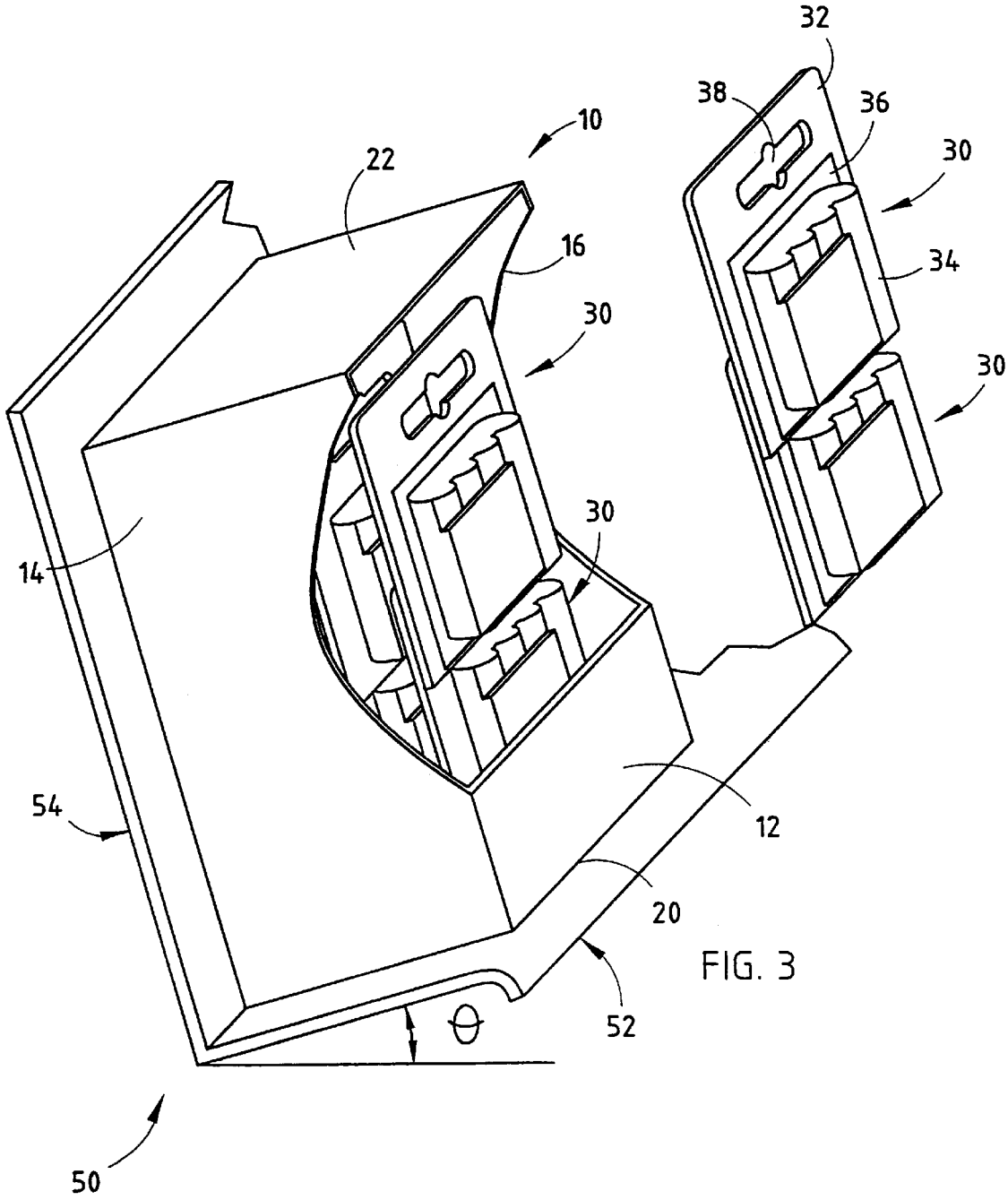
FIG. 3 is a perspective view of the fully opened container shown on a display shelf for displaying packaged articles, and further shows a pair of packaged articles removed.

Referring to FIG. 3, the shipping and display container 10 is shown located on a store display 50 with the tear section 24 completely removed so as to display the packaged articles for sale to consumers. The display 50 generally includes a shelf 52 for supporting the bottom wall 20 and an upstanding back support 54 for supporting the rear wall 18. The shelf 52 is preferably raised at its outer edge so that it is angularly tilted at an angle θ in the range of 20 degrees to 30 degrees relative to the horizontal plane. Packaged articles, such as battery packages 30 containing battery product, are efficiently arranged within the container 10 for display to consumers. The battery packages 30 are arranged in container 10 in an efficient manner that consumes a small amount of volume, and yet offers the packages 30 ready for display following shipment without requiring manual reorientation of the packages 30. This is because all of the battery packages 30 are arranged in container 10 facing the front wall 12 and are therefore readily viewable to consumers.

Packages 30 are arranged in container 10 to include upper packages supported on lower packages. Each upper package is slightly offset and disposed on a lower package. Adjacent pairs, made up of an upper package and an adjacent lower package, are stacked one pair behind the other to substantially fill the volume of container 10. It should be appreciated that by tilting the container 10 at angle θ, the packages 30 at the front side rest partially on the rearward packages to enhance stability of the package arrangement.

Figure 4:
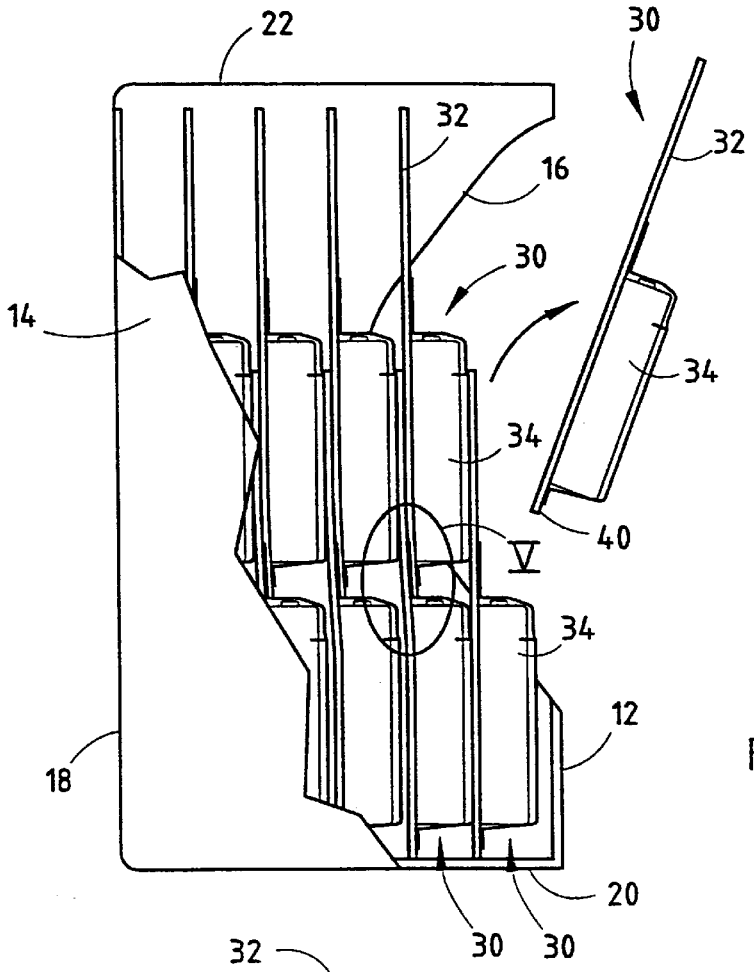
FIG. 4 is a side elevational view, partially broken away, of the container further illustrating the arrangement of the packaged articles according to a first embodiment.

As shown in FIG. 4, battery package 30 includes a display card 32 and a thermoformed blister 34 heat sealed or otherwise bonded to the display card 32. Blister 34 is closed against display card 32 to define a closed compartment for storing one or more products, such as batteries. Alternately, the blister 34 alone may define a closed compartment for containing the product(s). The blister 34 is generally located near the lower edge 40 of the battery package 30 and has a thickness, i.e., front-to-rear distance, substantially greater than the thickness of the display card 32. As a consequence, battery package 30 has a non-uniform, i.e., irregular, shape. Display card 32 is preferably made of cardboard, according to one example; however, display card 32 may be made of other materials, such as paperboard or polymeric materials. The display card 32 may include graphics and print for providing indicia such as product description, advertisement, and instructions. Blister 34 is preferably made of a thermoformed polymeric material as is generally known in the art; however, alternate housing materials, such as injection molded polymeric material, may also form the product housing.

Figure 5:
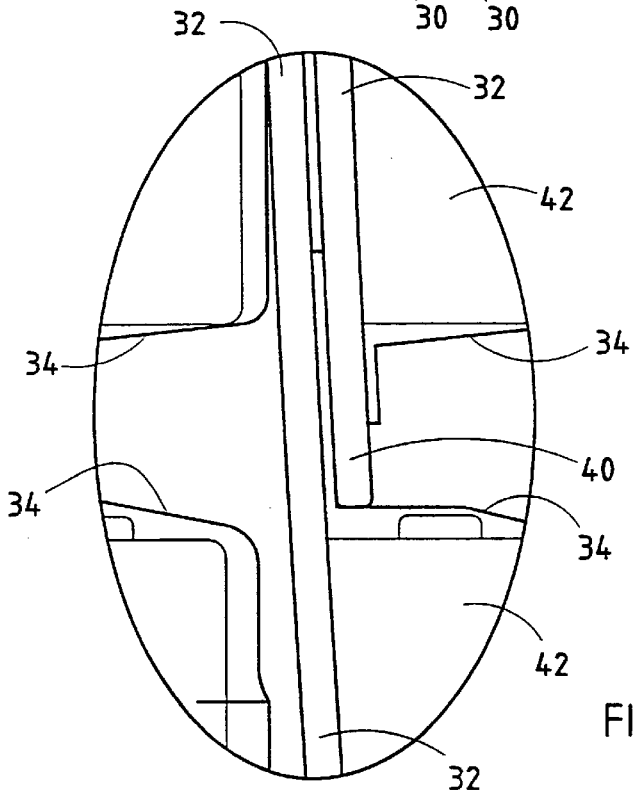
FIG. 5 is an enlarged view of section V in FIG. 4.

The lower edge (end) 40 of each of the lower battery packages 30 rests on top of the bottom or lower wall 20 of container 10. Each of the upper packages 30 are efficiently disposed in the container 10 such that its lower edge 40 rests on top of the thermoformed blister 34 of a lower package 30 to provide a double-stacked arrangement of packages. With particular reference to FIG. 5, the lower edge 40 of an upper package 30, containing batteries 42, is shown resting on top of the upper surface of blister 34 of a lower package 30, which likewise houses batteries 42. While the lower edge 40 of display card 32 is shown formed as a continuation of the display card 32, it should be appreciated that the lower edge 40 of package 30 may be provided by the polymeric thermoformed blister, according to another embodiment. Additionally, while a double stacked arrangement of packages 30 is shown, it should also be appreciated that other multiples of packages may be stacked to include three or more packages located one on top of another, e.g., triple-stacked, quadruple-stacked, etc.

Accordingly, the shipping and display container 10 of the present invention efficiently contains packaged products for shipping and display to consumers in a retail store without requiring rehandling of the individual packaged products following shipment. Further, the arrangement of the container 10 and plurality of packaged products provides improved product density at the retail store. According to the example shown, the container 10 is preferably located on a tilted shelf for display to consumers. However, it should be appreciated that the container 10 may be otherwise configured to provide a built-in support stand or may include a non-rectangular shape having an integral tilted orientation formed therein.

Figure 6:
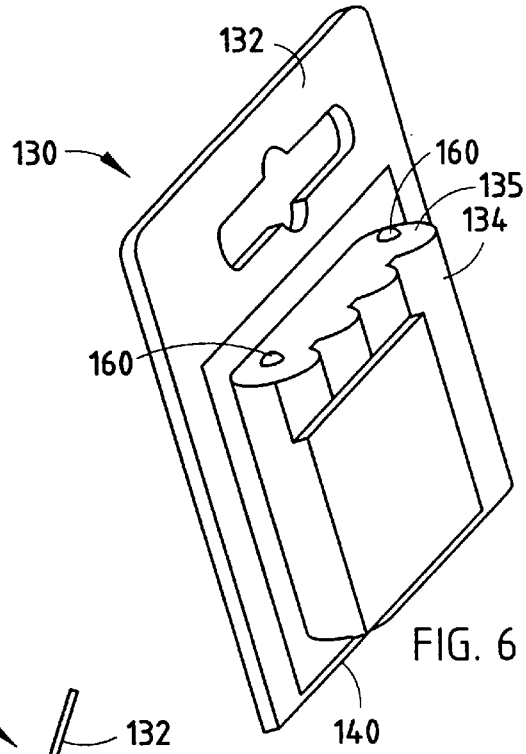
FIG. 6 is an elevated perspective view of a packaged article having a pair of retaining members according to a second embodiment of the present invention.

Referring to FIG. 6, a battery package 130 is shown according to a second embodiment of the present invention. Battery package 130 includes a display card 132 and a thermoformed blister 134 heat sealed or otherwise bonded to the display card 132. The blister 134 is closed against display card 132 to define a closed compartment for storing products, such as batteries. Blister 134 is generally located near the lower edge 140 of battery package 130 and has a thickness substantially greater than the thickness of the display card 132. Battery package 130 is configured similar to package 30, with the addition that package 130 has a pair of raised (convex) retaining dimples formed on an upper generally horizontal surface 135 of the thermoformed blister 134. The raised retaining dimples 160 are preferably spaced from one another on opposite sides of blister 134, and are further spaced from the display card 132 by a distance of at least the thickness of display card 132 so that the lower edge 140 of upper display card 132 fits between the lower display card 132 and dimples 160. Accordingly, raised retaining dimples 160 provide a vertical disposed support member to retain the upper package 130 on top of the lower package 130.

Figure 7:
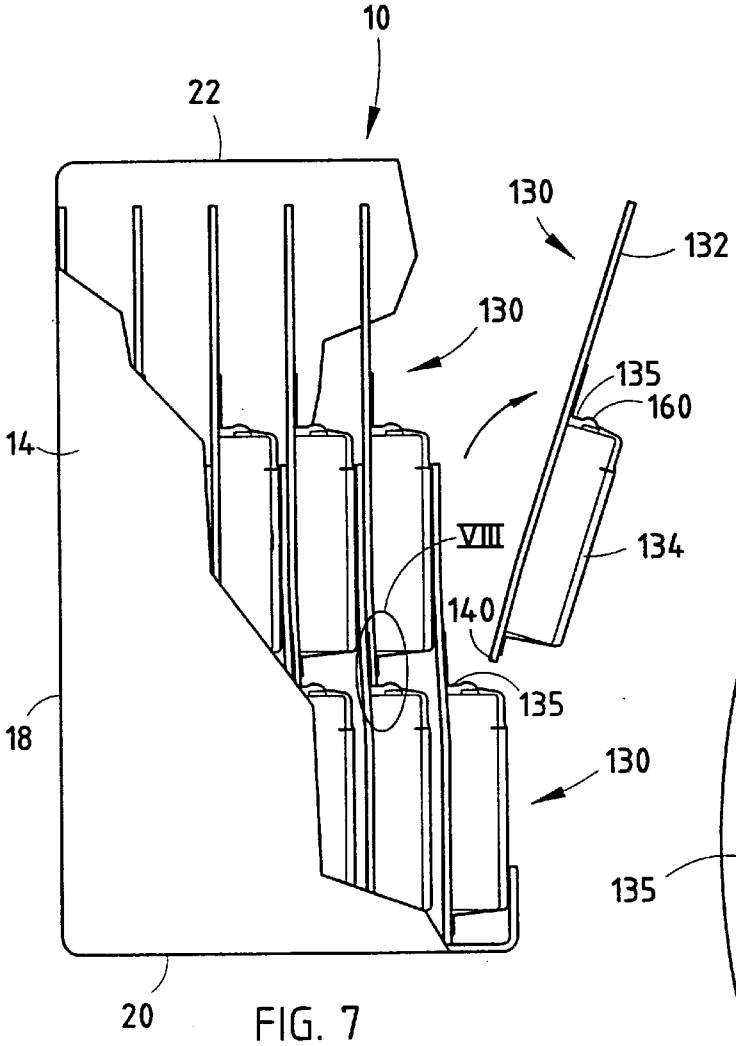
FIG. 7 is a side elevational view, partially broken away, of the container illustrating the arrangement of packaged articles according to the second embodiment shown in FIG. 6.

Referring to FIG. 7, a plurality of battery packages 130 are shown arranged in container 10 in a double stacked arrangement having upper packages 130 supported on lower packages 130. As discussed in connection with package 30 of the first embodiment, each upper package 130 is slightly offset and disposed on top of the upper surface 135 of the thermoformed blister 134 of a lower package 130. According to the second embodiment, the raised retaining dimples 160 extend vertically upward from the upper surface 135 of thermoformed blister 134 so as to engage and retain the lower edge 140 of an upper supported battery package 130 in a substantially fixed relation and thereby prevent the lower edge 140 of the upper battery package 130 from sliding forward relative to the lower battery package 130.

Figure 8:
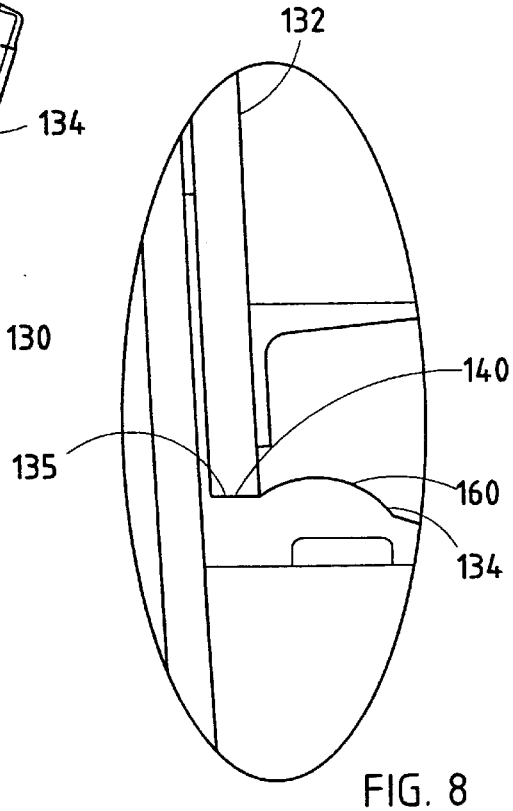
FIG. 8 is an enlarged view of section VIII in FIG. 7.

As is more particularly shown in FIG. 8, the raised retaining dimples 160 provide a raised surface forward from the display card 132 to allow for the lower edge 140 of an upper supported battery package 130 to be engaged and held in place. Raised retaining dimples 160 prevent horizontal sliding movement of the lower edge 140 of upper supported battery package 132 relative to the lower supporting battery package. Accordingly, the raised retaining dimples 160 advantageously hold the stacked packages in a fixed relationship within container 10 and prevent sliding movement of the lower end 140 of each upper package 130 which may otherwise inadvertently fall forward through the dispensing opening in container 10. While a pair of retaining dimples 160 are shown, it should be appreciated that any number of one or more retaining dimples may be employed to retain the stacked arrangement of packages 130, without departing from the spirit of the present invention.

Figure 9:
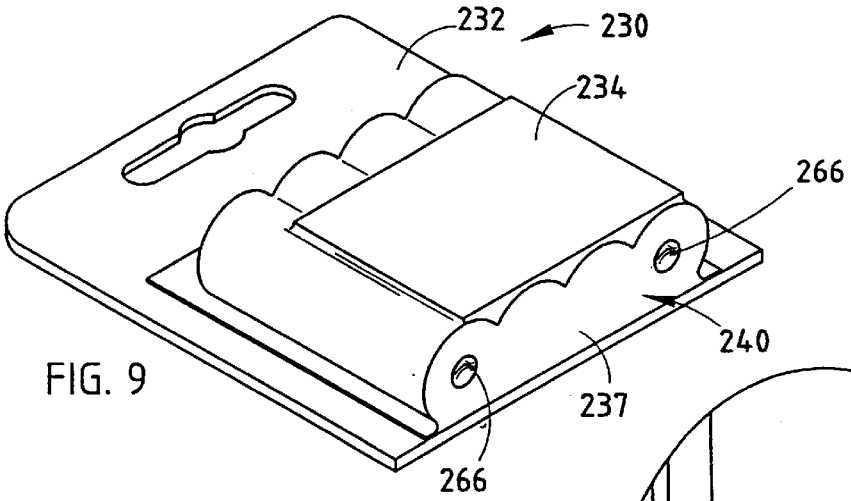
FIG. 9 is a perspective view of a packaged article having a pair of depressions formed in the bottom of the housing for engaging retaining members according to a third embodiment of the present invention.

Referring to FIG. 9, a battery package 230 is shown according to a third embodiment of the present invention for use in the product shipping and display container 10. Battery package 230 includes a display card 232 and a thermoformed blister 234 preferably heat sealed or otherwise attached to the display card 232. The blister 234 is closed on all sides and trapped between two layers of display card 232 to define a closed compartment for storing products, such as batteries. In contrast to battery package 30 or 130, the blister 234 of battery package 230 has a substantially planar lower surface 237 that forms the lower end 240 of battery package 230. Battery package 230 likewise has a blister 234 with a substantially greater thickness than the thickness of the display card 232. Battery package 230 has a pair of raised convex retaining dimples 260 formed on the upper surface 235 of blister 234 as described above. In addition, battery package 230 has a pair of concave depressions 266 formed in the lower surface 237 of blister package 234. Depressions 260 are preferably localized depressions that substantially match the shape and size of the raised retaining dimples 260 which are formed on the upper surface 235 of blister 234.

Figure 11:
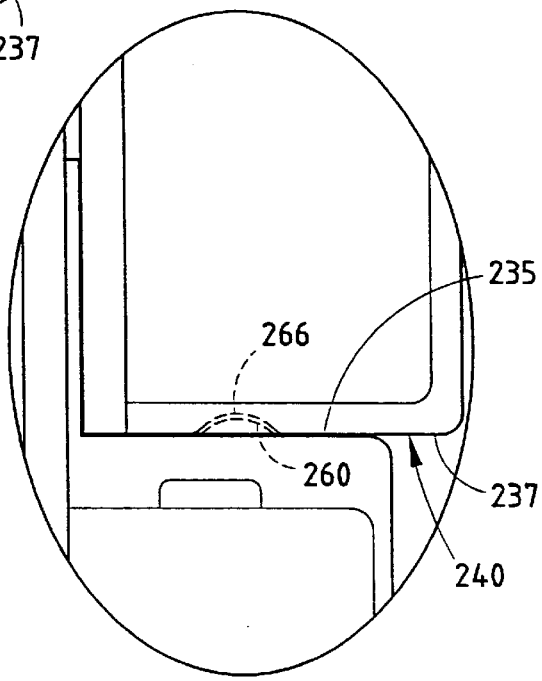
FIG. 11 is an enlarged view of section XI in FIG. 10.
Figure 10:
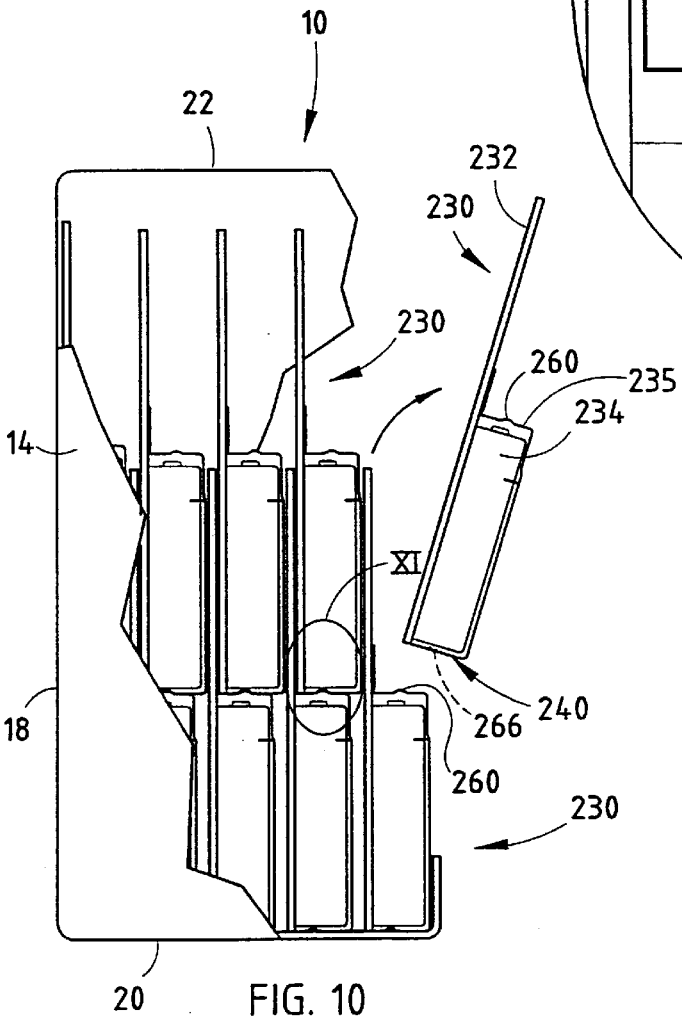
FIG. 10 is a side elevational view, partially broken away, of the container further illustrating the arrangement of the packaged articles having retaining members according to the third embodiment shown in FIG. 9.

As is more clearly shown in FIGS. 10 and 11, a plurality of battery packages 230 are arranged in container 10 in a double stacked arrangement having upper packages supported on lower packages. As discussed in connection with package 130 of the second embodiment, each upper package is slightly offset and disposed on the upper surface of the thermoformed blister of a lower package. According to the third embodiment, the raised retaining dimples 160 extend vertically upward from upper surface 235 of blister 234 of the lower package and matingly engage the depressions 260 formed in the lower end 240 of the upper package. The mating engagement of raised retaining dimples 260 with the corresponding depressions 266 retains the upper and lower packages in a substantially fixed relationship relative to each other. Thus, sliding of an upper package 230 relative to the supportive lower package 230 is prevented. While a pair of raised retaining dimples 260 and a corresponding pair of depressions 266 are shown, it should be appreciated that any number of one or more retaining dimples and depressions may be employed to retain the stacked arrangement of packages 230, without departing from the teachings of the present invention.

Figure 12:
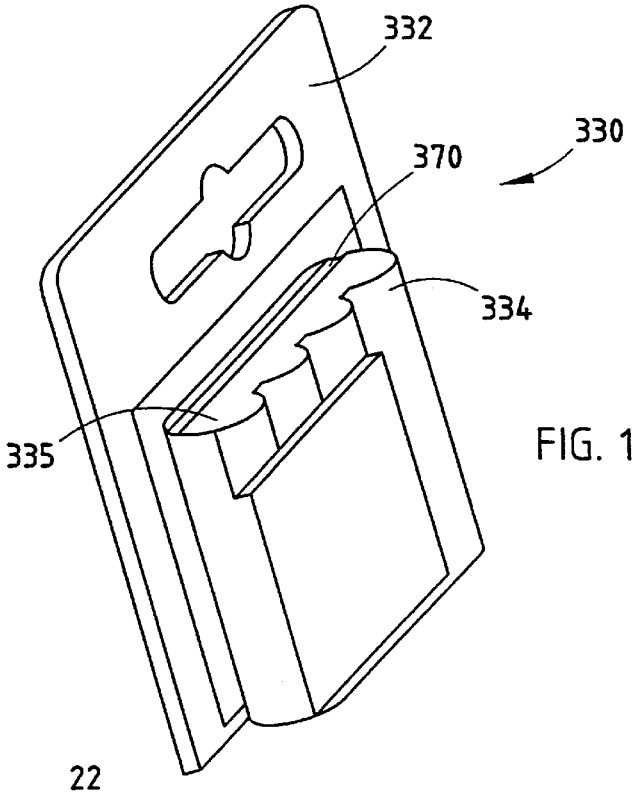
FIG. 12 is an elevated perspective view of a packaged article having a retaining channel according to a fourth embodiment of the present invention.

Referring to FIG. 12, a battery package 330 is shown according to yet a fourth embodiment of the present invention for use in the product shipping and display container 10. Battery package 330 includes a display card 332 and a thermoformed blister 334 heat sealed or otherwise bonded to the display card 332. The blister 334 is closed against display card 332 to define a closed compartment for storing products, such as batteries. Blister 334 is generally located near the lower edge 340 of battery package 330 and has a thickness substantially greater than the thickness of the display card 332. Battery package 330 is configured similar to package 30 of the first embodiment, with the addition that package 330 has an elongated concave channel 370 formed in the upper surface 335 of thermoformed blister 334. The channel 370 preferably extends the entire side-to-side length of surface 335 and is substantially parallel to display card 332. Channel 370 is preferably located close to the front surface of display card 332; however, channel 370 may be adjacent to or may be spaced at various distances from display card 332 as should be evident to those skilled in the art.

Figure 13:
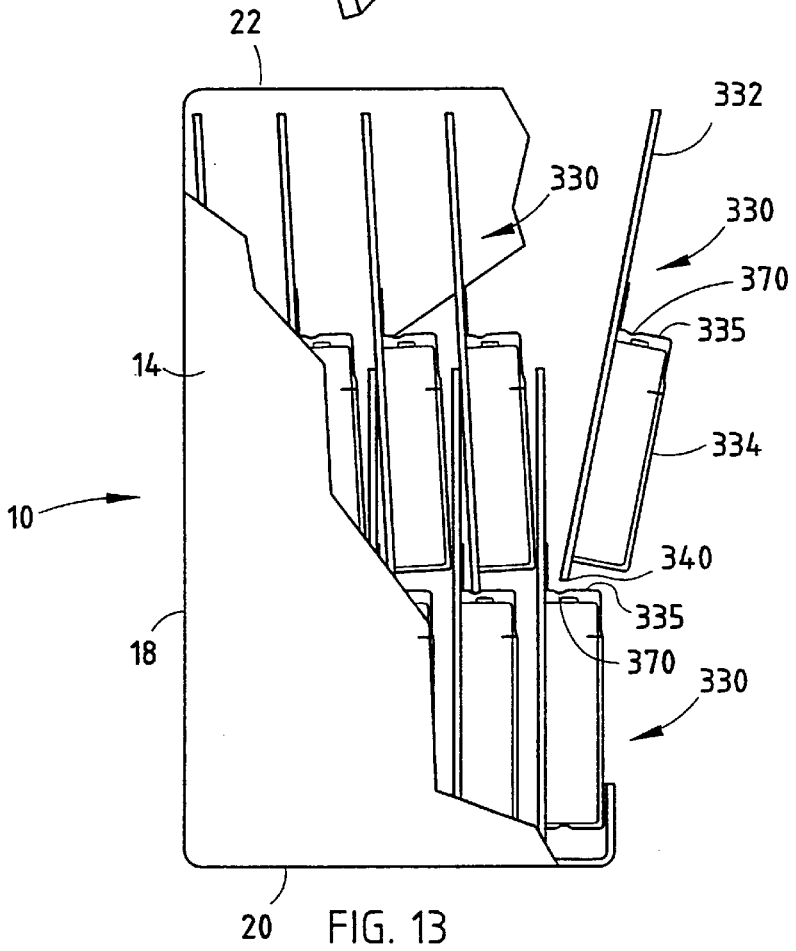
FIG. 13 is a side elevational view, partially broken away, of the container illustrating the arrangement of the packaged articles according to the fourth embodiment shown in FIG. 12.

With particular reference to FIG. 13, a plurality of battery packages 330 are shown arranged in container 10 in a double stacked arrangement having upper packages 330 supported on lower packages 330. As discussed in connection with the packages 30, 130, and 230 of the previous embodiments, each upper package 330 is slightly offset and disposed on the upper surface 335 of the thermoformed blister 334 of a lower package 330. According to the fourth embodiment, the lower edge (end) 340 of the upper display card 332 is disposed within the channel 370 on the top surface 335 of blister 334 on the lower package so as to matingly engage and retain lower edge 340. The engagement of lower edge 340 of an upper package 330 with channel 370 prevents relative forward and rear movement of the upper package 330 relative to the lower package 330. Thus, the upper package 330 is prevented from sliding forward or rearward relative to the lower package 330.

While the channel 370 is shown engaging the lower end 340 of a display card 332 of an upper package 330, the battery package 330 could otherwise be configured to include a rib formed in the bottom surface of the thermoformed blister 334 for engaging channel 370. While packages 130, 230, and 330 are shown and described herein configured with raised dimples, depressions, and a channel, it should be appreciated that the battery packages of the present invention could employ other male and female type retainers of various shapes and sizes, without departing from the teachings of the present invention. Further, it should be appreciated that the packages 130, 230, and 330 containing retaining members, including raised dimples, depressions, and a channel, may be used with or without container 10 according to other aspects of the present invention.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A combination container and arrangement of packaged articles for shipment and display to consumers, comprising:

a container having side walls and top and bottom walls defining a compartment, said container further having a removable material engaging said container to retain packaged articles during shipment of the packaged articles and removable to provide an opening for displaying the packaged articles for sale to consumers;

a plurality of packaged articles arranged in said container, each of said packaged articles having a substantially planar support member and a housing for housing one or more products, said housing having a thickness substantially greater than the thickness of said display card, wherein said packaged articles include an upper packaged article offset and supported on a lower packaged article and accessible via the opening for display and removal by consumers; and a retainer formed on the lower packaged article for retaining the upper packaged article supported on the lower packaged article, wherein said retainer is formed on an upper surface of said housing, and wherein said housing further comprises a depression formed in a lower surface of the upper packaged article for matingly engaging a raised member of the lower packaged article.

2. A combination container and arrangement of packaged articles for shipment and display to consumers, comprising:

a container having side walls and top and bottom walls defining a compartment, said container further having a removable material engaging said container to retain packaged articles during shipment of the packaged articles and removable to provide an opening for displaying the packaged articles for sale to consumers;

a plurality of packaged articles arranged in said container, each of said packaged articles having a substantially planar support member and a housing for housing one or more products, said housing having a thickness substantially greater than the thickness of said display card, wherein said packaged articles include an upper packaged article offset and supported on a lower packaged article and accessible via the opening for display and removal by consumers; and a retainer formed on the lower packaged article for retaining the upper packaged article supported on the lower packaged article, wherein said retainers comprises a channel formed in an upper surface of said housing for receiving a lower end of said upper packaged housing.

3. A combination container and arrangement of packaged articles for shipment and display to consumers, comprising:

a container having side walls and top and bottom walls defining a compartment, said container further having a removable material engaging said container to retain packaged articles during shipment of the packaged articles and removable to provide an opening for displaying the packaged articles for sale to consumers;

a plurality of packaged articles arranged in said container, each of said packaged articles having a substantially planar support member and a housing for housing one or more products, said housing having a thickness substantially greater than the thickness of said display card, wherein said packaged articles include an upper packaged article offset and supported on a lower packaged article and accessible via the opening for display and removal by consumers; and a retainer formed on the lower packaged article for retaining the upper packaged article supported on the lower packaged article, wherein said packaged articles comprise battery packages each containing one or more batteries.

4. The combination container and packaged articles as defined in claim 3, wherein said retainer is formed on an upper surface of said housing.

5. The combination container and packaged articles as defined in claim 4, wherein said retainer comprises at least one raised member spaced from said support member.

6. The combination container and packaged articles as defined in claim 5, wherein said retainer comprises a pair of raised members spaced from one another.

7. The combination container and package articles as defined in claim 4, wherein said raised member comprises a rib spaced from said support member.

8. The combination container and packaged articles as defined in claim 3, wherein said support member comprises a display card.

9. The combination container and package articles as defined in claim 3, wherein said packaged articles are irregularly shaped articles having a front-to-rear thickness that varies.

10. The combination container and packaged articles as defined in claim 3, wherein said housing comprises a thermoformed blister.

11. The combination container and packaged articles as defined in claim 3, wherein said removable material comprises a removable section.

12. The combination container and packaged articles as defined in claim 11, wherein said removable section comprises perforations formed in said container so that the removable section can be torn from the container.

13. A package display arrangement comprising:

a lower packaged article having a display card and a housing for housing one or more products, said housing having a thickness substantially greater than the thickness of the display card;

an upper packaged article having a display card and a housing for housing one or more products, said housing having a thickness substantially greater than the thickness of said display card, wherein said upper packaged article is offset and supported on top of said lower packaged article; and a retainer for retaining said upper packaged article supported on top of said lower packaged article, wherein said retainer is formed on an upper surface of said housing of said lower packaged article, and wherein said retainer comprise a channel formed in the upper surface of said housing for receiving a lower end of said upper packaged article.

14. A package display arrangement comprising:

a lower packaged article having a display card and a housing for housing one or more products, said housing having a thickness substantially greater than the thickness of the display card;

an upper packaged article having a display card and a housing for housing one or more products, said housing having a thickness substantially greater than the thickness of said display card, wherein said upper packaged article is offset and supported on top of said lower packaged article; and a retainer for retaining said upper packaged article supported on top of said lower packaged article, wherein said retainer is formed on an upper surface of said housing of said lower packaged article and said retainer comprises a raised member spaced from said display card, and wherein said housing of said upper packaged article has a depression formed in a lower surface for matingly engaging said raised member formed in the lower packaged article.

15. A package display arrangement comprising:

a lower packaged article having a display card and a housing for housing one or more products, said housing having a thickness substantially greater than the thickness of the display card;

an upper packaged article having a display card and a housing for housing one or more products, said housing having a thickness substantially greater than the thickness of said display card, wherein said upper packaged article is offset and supported on top of said lower packaged article; and a retainer for retaining said upper packaged article supported on top of said lower packaged article, wherein said upper and lower packaged articles each comprise battery packages containing one or more batteries.

16. The package display arrangement as defined in claim 15, wherein said retainer is formed on an upper surface of said housing of said lower packaged article.

17. The package display arrangement as defined in claim 16, wherein said retainer comprises a raised member spaced from said display card.

18. The package display arrangement as defined in claim 17, wherein said retainer comprises a pair of raised members spaced from said display card.

* * * * *